US006376449B2

(12) United States Patent
Olsen

(10) Patent No.: US 6,376,449 B2
(45) **Date of Patent: *Apr. 23, 2002**

(54) ACIDIC CLEANING COMPOSITION COMPRISING AN ACIDIC PROTEASE I

(75) Inventor: Hans Sejr Olsen, Holte (DK)

(73) Assignee: Novozymes A/S, Bagsvaerd (DK)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/274,542

(22) Filed: Mar. 23, 1999

Related U.S. Application Data

(60) Provisional application No. 60/112,169, filed on Dec. 14, 1998, provisional application No. 60/085,484, filed on May 14, 1998, and provisional application No. 60/080,858, filed on Apr. 6, 1998.

(30) Foreign Application Priority Data

| | | |
|---|---|---|
| Mar. 27, 1993 | (DK) | 9800434 |
| May 11, 1998 | (DK) | 9800635 |
| Dec. 11, 1998 | (DK) | 9801637 |

(51) Int. Cl.[7] ..... C11D 3/386; C11D 1/66

(52) U.S. Cl. ..... 510/392; 510/161; 510/188; 510/194; 510/195; 510/220; 510/226; 510/235; 510/320; 510/321; 510/530

(58) Field of Search ..... 510/161, 194, 510/220, 226, 223, 235, 190, 191, 320, 321, 195, 396, 530, 188; 8/137; 134/42, 25.2

(56) References Cited

U.S. PATENT DOCUMENTS

| | | | | |
|---|---|---|---|---|
| 5,371,190 A | | 12/1994 | Carter et al. | 530/350 |
| 5,698,507 A | * | 12/1997 | Gorlin et al. | 510/223 |
| 5,853,430 A | * | 12/1998 | Shindo et al. | 8/137 |
| 5,854,050 A | * | 12/1998 | Dalboge et al. | 435/219 |

FOREIGN PATENT DOCUMENTS

| | | | |
|---|---|---|---|
| DE | 38 33 047 | | 4/1990 |
| EP | 0 082 395 | | 6/1983 |
| EP | 0082395 | * | 6/1983 |
| WO | 95/02044 | * | 6/1983 |
| WO | WO 90/10072 | | 9/1990 |
| WO | WO 95/02044 | | 1/1995 |
| WO | WO 96/23579 | | 8/1996 |
| WO | WO 96/29978 | | 10/1996 |

* cited by examiner

*Primary Examiner*—Charles Boyer
(74) *Attorney, Agent, or Firm*—Elias J. Lambiris

(57) ABSTRACT

Acidic detergent composition comprising (a) protease I obtainable from *Aspergillus aculeatus* and having a pH optimum of 3 to 6 and (b) at least one nonionic surfactant and methods for using the composition for cleaning or washing a hard surface or laundry.

23 Claims, No Drawings

ACIDIC CLEANING COMPOSITION COMPRISING AN ACIDIC PROTEASE I

CROSS-REFERENCE TO RELATED APPLICATIONS

This application claims priority under 35 U.S.C. 119 of U.S. provisional application Nos. 60/080,858, 60/085,484 and 60/112,169 filed Apr. 6, 1998, May 14, 1998 and Dec. 14, 1998, respectively, and of Danish application nos. PA 1998 00434, PA 1998 00635 and PA 1998 01637 filed Mar. 27, 1998, May 11, 1998 and Dec. 11, 1998, respectively, the contents of which are fully incorporated herein by reference.

FIELD OF THE INVENTION

The present invention relates to a cleaning composition comprising an acidic substantially pepstatin-insensitive protease and a nonionic surfactant. The composition is suitable for cleaning hard surfaces or cellulosic and/or woolen fabrics at acidic pH.

BACKGROUND OF THE INVENTION

The majority of cleaning compositions used in household and industry today is alkaline.

Industrial cleaning like CIP ("Cleaning in Place") cleaning, e.g. cleaning of membranes in dairies or other food processing industries, often involves both an acid treatment whereby mineral deposits, e.g. hardness salts (scale) such as milk-stone, are removed, and an alkaline detergent treatment removing organic matter, e.g. fats, proteins and/or sugars. The process often comprises the following steps:

RINSING→ALKALI→RINSING→ACID→RINSING

Lack of industrially producible acidic proteases effective at acidic pH has obstructed the development of enzymatic cleaning processes for dishes, laundry and industrial and household hard surfaces under acidic conditions, and only few attempts have been made to develop an exclusively acidic cleaning process although there is a desire for such advantageous acidic cleaning compositions.

DE 3833047 A1 discloses acidic ADW (Automatic Dish Washing) detergent compositions comprising a hydrolase enzyme, wherein the hydrolase may be an amylase, a protease or a lipase.

U.S. Pat. No. 5,698,507 discloses a gelled dishwashing composition having a pH of 3–5 consisting essentially of specified amounts of nonionic surfactant, citric acid, $H_2O_2$, at least one acid resistant protease enzyme, at least one amylase enzyme, hydrotrope, $CaCl_2$, sodium formate, a gelling system and water. Specifically named enzymes were *Bacillus amyloliquefaciens* α-amylases (e.g. Tenase 1200, Tenase L-1200 and Tenase L-340) and *Aspergillus niger* or *Aspergillus oryzae* proteases.

WO 95/02044 discloses acidic aspartic proteases obtainable from *A. aculeatus* (denoted protease I and protease II) for use in the production of food, animal feed, beverages, leather and for contact lens cleaning.

WO 96/29978 discloses an acidic oral care composition comprising acidic protease, which in the normal, slightly alkaline oral environment is substantially inactive.

WO 96/23579 discloses cleaning of membranes in a beer filtration process comprising at least a) treatment of the membrane with an enzyme-containing aqueous solution with beta-glucanase, xylanase and cellulase; b) cleaning with an acidic cleaning agent and c) cleaning with a peroxide containing alkaline solution.

SUMMARY OF THE INVENTION

We have found that proteases which retain proteolytic activity in the presence of an inhibitor selected from the group consisting of pepstatin, PEFABLOC, PMSF, or EDTA) exhibit a surprisingly good cleaning and/or activity performance at acidic conditions compared to other acidic proteases with a similar pH-activity profile. Accordingly, the invention provides advantages over the art of alkaline detergent compositions such as:

a) a peroxygen/activator bleach system, e.g. sodium-perborate or percarbonate and TAED activators that can oxidize or bleach poly-aromatic compounds present in soiling or stains becomes more effective even at low temperatures, b) an enzyme-enhancer bleaching system, e.g. peroxidase-PPT or laccase-PPT may be used even at low temperatures.

The acidic condition has in itself a bleaching effect on some types of stains, e.g. coffee and tea, c) an alkaline cleaning step and a rinsing step in industrial hard surface cleaning, e.g. CIP may be omitted as the acidic detergent composition may remove organic soils as well inorganic soil or stains, d) omission of an alkaline cleaning step will reduce damaging of the hard surface.

e) Builder systems usually present in alkaline laundry detergents may in acidic laundry detergents be lowered or even omitted as surfactants usually are not precipitated by water hardness ions at acidic pH. This in turn means that scaling in cleaning equipment, e.g. a automatic laundry washing machine, may be avoided.

The invention thus provides in a first aspect an acidic detergent composition comprising an acidic protease which retains proteolytic activity in the presence of an inhibitor selected from the group consisting of pepstatin, PEFABLOC, PMSF, or EDTA and at least one nonionic surfactant, for hard surface and laundry cleaning.

DETAILED DESCRIPTION OF THE INVENTION

Definitions

The term "hard surface" as used herein relates to any surface which is essentially non-permeable to water. Examples of hard surfaces are surfaces made from metal, e.g. stainless steel or other alloys, plastics/synthetic polymers, rubber, glass, wood, concrete, rock, marble, gypsum and ceramic materials all which optionally may be coated, e.g. with paint, enamel, polymers and the like.

The term "inhibitor" as used herein relates to compounds which competitively or non-competitively interacts with the protease thereby reducing and/or destroying the enzyme activity towards the substrate of the enzyme.

The term "retains proteolytic activity" is to be construed as the protease having the property of retaining at least 75% of its activity (residual activity) measured in HPU units at pH 5.5 after treatment of the protease with inhibitor, the inhibitor being either 1 mM pepstatin, 0.1% PFABLOC, 0.1% PMSF or 100 mM EDTA.

The Protease

The protease in the context of the invention is an acidic protease which retains proteolytic activity in the presence of an inhibitor selected from the group consisting of pepstatin, PEFABLOC, PMSF, or EDTA. Inhibition by pepstatin which has the formula:

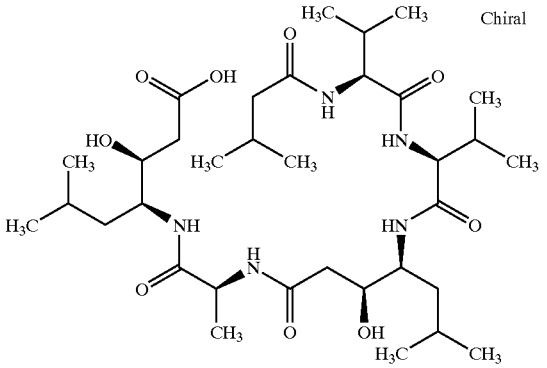

is described by Muroa S. and Oda K. (1985).

A characterization of the protease with regard to inhibition in the context of the invention is shown in WO 95/02044. An inhibition test shows that Protease I is not inhibited by pepstatin. Protease II is inhibited by pepstatin. According to Oda K. and Murao S. (1991) acidic proteases are described in two classes as carboxyl or aspartic proteases sensitive to pepstatin and pepstatin-insensitive carboxyl proteinases. Reference is also given to Muroa S. and Oda K. (1985), where this new subclass for acidic proteases was introduced.

PMSF is an inhibitor of the formula:

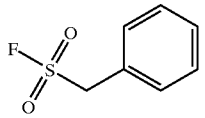

while PEFABLOC is a protease inhibitor of the formula:

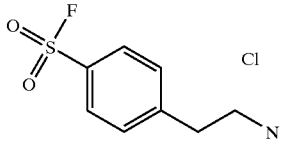

Preferred proteases are obtainable from a microorganism, e.g. a bacterial strain, e.g. Bacillus, Pseudomonas or Xanthomonas or a fungal strain (including yeasts) such as species of the genus Aspergillus (e.g. *A. aculeatus* or *A. niger*) or Scytalidium (e.g. *S. lignicolum*).

The proteases may in a further embodiment be obtainable from a bacterium or fungus, which has been genetically modified by transforming said bacterium or fungus with a DNA vector/construct comprising DNA encoding said protease.

The protease of the invention may, in a particularly preferred embodiment, comprise one or more aspartic and/or carboxylic residues as functional groups in the active center.

Further, the protease retains proteolytic activity in the presence of inhibitors present in meat, egg white, whole blood, blood plasma, milk, beer, potatoes or beans. Such inhibitors may be ovomacroglobulin, ovomucoid or ovoglycoprotein. It is presently contemplated that inhibitors (such as competitive or non-competitive inhibitors—terms that are known to the skilled person) present in soiling which is desired to be cleaned play an important role in the cleaning process as they may inactivate or reduce activity of enzymes which would otherwise hydrolyze the soiling. This may be the reason why it has been difficult to find suitable proteases for use in acidic cleaning compositions. The protease may further have a preferred pH optimum between 2–7, more preferred between 3–6 or even more preferred between 4.5–5.5. Also the protease according to the invention may have a temperature optimum between 20–70° C., such as between 20–60° C., e.g. 30–50° C.

In a further particular embodiment the protease is Protease I or Protease II obtainable from *A. aculeatus* as described in WO 95/02044, which is hereby incorporated by reference. A most preferred protease is Protease I.

The Nonionic Surfactant

Nonionic surfactants are especially suitable for acidic detergents since they are not functionally affected in a moderate acidic environment. Preferred nonionic surfactants are glycolipids, alcoholethoxylates, alkylphenolethoxylates, glucamides, and alkylpolyglucosides (Stache & Kosswig, 1990).

Other Suitable Composition Components

The composition may optionally comprise a sequestering agent, when water for preparing a washing liquor contains considerable water hardness, i.e. calcium ions which may affect the performance of the protease. Suitable sequestering agents should be capable of sequestering calcium ion at acidic pH. Preferred sequestering agents are methylglycinediacetic acid, nitrilotriacetic acid, citric acid, oligo and polymeric (poly)carboxylic acid derived from polymer sugars (Kock et al. 1993), dextrin and protein hydrolysates (DE 19547730 A1).

The composition may further comprise other components enhancing the detergency of the composition such as softening agents, an amylase (e.g. Fungamyl® from Novo Nordisk A/S, Denmark), a lipase (e.g. Novocor® AD from Novo Nordisk A/S, Denmark), a cellulase (e.g. Celluzyme®, Carezyme®, and/or Celluclast®, all from Novo Nordisk A/S, Denmark), a xylanase (e.g. Biofeed® PLUS or Shearzyme™ from Novo Nordisk A/S, Denmark), a beta-glucanase (e.g. Viscozyme® or Ultraflo™ from Novo Nordisk A/S, Denmark), a pectinase (e.g. Pectinex™ Ultra from Novo Nordisk A/S, Denmark), a peroxidase (e.g. Guardzyme™ from Novo Nordisk A/S, Denmark), a laccase (e.g. obtained from Myceliophthora or Polyporus), an enhancing agent for the peroxidase/laccase (e.g. PPT or methylsyringic acid methylsyringate or derivatives thereof) and/or a buffer (e.g. citric acid).

Finally the composition may be a liquid or a powder. In the latter case the protease may suitably be formulated as a stabilized granulate. The formulation may be obtained using conventional methods.

Uses of the Composition

The composition according to the invention may suitably be used in methods for cleaning or washing a hard surface or laundry. The methods may preferably comprise contacting the hard surface or laundry with the composition dissolved in an aqueous solution in an amount sufficient for providing a cleaning effect. The protease and the other composition components may alternatively be added to the solution separately.

The composition may preferably be dissolved in an amount sufficient for providing an enzyme dosage of 500–3000 HUT/L, preferably 500–1500 HUT/L, more preferably 750–1250 HUT/L, e.g. 1000 HUT/L wash liquor.

The hard surface to be cleaned or washed by the method is in one embodiment preferably industrial process equipment or household equipment.

Specific preferred industrial process equipment may be heat exchangers, tanks, pipes, centrifuges, evaporators, filters, extruders, meat choppers, cooking jars, beer and wine fermenters, beer and wine filters, spent filter aids, coolers, storage tanks, sieves, hydrocyclones, ultrafiltration units, nanofiltration units, hyperfiltration units, microfiltration units and milking machines.

A particularly suitable embodiment is cleaning of health care or animal care equipment or products. Health care equipment may comprise diagnostic/analytical (e.g. endoscopes, blood analyzers), processing (e.g. dialysis or blood treatment equipment) or surgical equipment (e.g. scalpels, peens, clips or tweezers, forceps, etc. used by doctors, veterinarians or dentists for treatment of patients) which has been in contact with blood, other body fluids or tissues from humans or animals.

With respect to cleaning of industrial process equipment the methods may in particular embodiments be "Cleaning in Place" (CIP) methods.

Specific preferred household equipment may be eating utensils, plates, cups, beakers, glasses, pots, pans, electric appliances, toilet bowls, lavatories or tiles.

Another suitable embodiment of the invention is cleaning of industrial ion exchange columns used in bulk sugar production for removing salts, residues of charged carbohydrates, protein and amino acids, and colored material before crystallization. Furthermore, ion exchange columns used in the starch based syrup production before and after the isomerization process may be cleaned using the composition of the invention.

An additional preferred embodiment of the invention is cleaning of ion exchangers used in manufacturing processes where proteins or peptides may cover and/or clog up the resin material with proteinaceous material. Usually such clogged up ion exchanges needs a cleaning process based on excessive alkaline and heat conditions, which reduces the lifetime of the resin and reduces the efficiency of the regeneration process (e.g. by using 85° C. hot alkali at pH=13–14 recirculated for about an hour). Use of the composition of the invention, however, provides a mild cleaning process, which may secure an efficient removing of soil that hinders an efficient regeneration process of such ion exchangers.

Yet another particularly suitable embodiment of the invention is cleaning of columns used for protein separation by gel filtration or affinity chromatography. Such columns often contain rather expensive separation and/or chromatography material/resin, which needs to be cleaned effectively if it is used for scaled up processes. Harsh conditions are normally used for removing slimy material such as combination products of protein and carbohydrates, which deposits in the material and these harsh conditions often reduce the lifetime of the material. Use of the composition of the invention, however, provides a mild cleaning process, which may secure an efficient cleaning and a prolonged lifetime of the column material. A preferred cleaning process for cleaning columns containing gel filtration and affinity chromatography material may comprise recirculating a cleaning solution containing an enzyme dosage of 500–3000 HUT/L, preferably 500–1500 HUT/L, more preferably 750–1250 HUT/L, e.g. 1000 HUT/L wash liquor at a pH between 2–7, preferably 3–6, e.g. 4–5, while the temperature should be kept between 10–65° C., preferably 30–50° C., e.g. 40° C. The cleaning or washing time in a preferred embodiment is kept between 2 minutes and 20 hours depending on the type of method.

With respect to cleaning of household equipment, the methods may in particular embodiments be performed in an automatic dishwashing machine.

When using the composition for cleaning or washing of laundry the method may preferably be performed in an industrial scale or household scale washing machine. Preferred laundry is cellulosic fabric and/or non-structured garments such as silk, acetate, wool, ramie, or rayon garments. Cleaning of especially wool and silk according to the invention is useful, as acidic cleaning conditions softens the garments as well as having a antimicrobial effect (i.e. kills or inhibits microbial cells).

The methods for cleaning or washing of hard surfaces or laundry may in one embodiment be performed at a pH between 2–7, preferably 3–6, e.g. 4–5, while the temperature should be kept between 10–65° C., preferably 30–50° C., e.g. 40° C. The cleaning or washing time in a preferred embodiment is kept between 2 minutes and 20 hours depending on the type of method. For instance cleaning of an industrial membrane may provide soaking in a (circulating) solution of the composition for up to overnight (up to 20 hours), while industrial dishwashing should be completed within 2–10 minutes.

MATERIALS AND METHODS

Determination of Protease HUT Activity

The HUT activity was determined according to the AF92/2 method published by Novo Nordisk A/S, Denmark. 1 HUT is the amount of enzyme which, at 40° C. and pH 4.7 over 30 minutes, forms a hydrolysate from digesting denatured hemoglobin equivalent in absorbancy at 275 nm to a solution of 1.10 μg/ml tyrosine in 0.006 N HCl which absorbancy is 0.0084. The denatured hemoglobin substrate is digested by the enzyme in a 0.5 M acetate buffer at the given conditions. Undigested hemoglobin is precipitated with trichloroacetic acid and the absorbance at 275 nm is measured of the hydrolysate in the supernatant.

Proteolytic of Protease HPU Activity 1 hemoglobin protease unit (hpu) is defined as the amount of enzyme liberating 1 millimole of primary amino groups (determined by comparison with a serine standard) per minute under standard conditions as descried below:

A 2% (w/v) solution of hemoglobin (bovine, supplied by Sigma) is prepared with the Universal Buffer described by Britton and Robinson, *J. Chem. Soc.,* 1931, p. 1451), adjusted to a pH of 5.5. 2 ml of the substrate solution are pre-incubated in a water bath for 10 min. at 25° C. 1 ml of an enzyme solution containing b g/ml of the enzyme preparation, corresponding to about 0.2–0.3 hpu/ml of the Universal Buffer (pH 5.5) is added. After 30 min. of incubation at 25° C., the reaction is terminated by the addition of a quenching agent (5 ml of a solution containing 17.9 g of trichloroacetic acid, 29.9 g of sodium acetate and 19.8 g of acetic acid made up to 500 ml with deionized water). A blank is prepared in the same way as the test solution with the exception that the quenching agent is added prior to the enzyme solution. The reaction mixtures are kept for 20 min. in a water bath after which they are filtered through Whatman 42 paper filters.

Primary amino groups are determined by their color development with o-phthaldialdehyde (OPA), as follows: 7.62 g of disodium tetraborate decahydrate and 2.0 g of sodium dodecylsulfate are dissolved in 150 ml of water. 160 mg of OPA dissolved in 4 ml of methanol were then added together with 400 ml of β-mercaptoethanol after which the solution is made up to 200 ml with water. To 3 ml of the OPA reagent are added 400 ml of the filtrates obtained above, with mixing. The optical density (OD) at 340 nm is measured after about 5 min. The OPA test is also performed with a serine standard containing 10 mg of serine in 100 ml of Universal Buffer (pH 5.5). The buffer alone is used as a blank. The protease activity is calculated from the OD measurements by means of the following formula:

$$hpu/\text{ml enzyme solution}: \frac{(OD_t - OD_b) \times C_{SER} \times Q}{(OD_{SER} - OD_B) \times MW_{SER} \times t_i}$$

hpu/g of enzyme preparation=hpu/ml: b wherein $OD_t$, $OD_b$, $OD_{SER}$ and $OD_B$ is the optical density of the test solution, blank, serine standard and buffer, respectively, $C_{SER}$ is the concentration of serine (mg/ml) in the standard (in this case 0.1 mg/ml), and $MW_{SER}$ is the molecular weight of serine (105.09). Q is the dilution factor for the enzyme solution (in this case 8) and $t_i$ is the incubation time in minutes (in this case 30 minutes).

Method for Evaluating the Composition in Automatic Dishwashing (ADW)

Stainless steel plates and porcelain dishes had been prewashed by 75° C. at high alkaline pH before soiling. Efficiency of proteases were tested using a standard laboratory procedure where stainless steel plates were soiled in the following way: 15 eggs (white+yolk) and 255 ml of whole milk were mixed at the lowest speed in a Braun UK 20 kitchen mixer machine for 2 minutes. Thereafter the mixed solution passed through a 0.5 mm pore size sieve. Five stainless steel plates were dipped into the egg/milk mixture and placed in a drying rack. After drying overnight at room temperature, the plates were baked for 1 hour at 120° C. in a ventilated thermostated oven. To test amylases, five porcelain plates are soiled using a 2% suspension of gelatinized starch solution which is dried overnight at room temperature.

For the automatic dishwashing procedure, a 6 persons Cylinda Excellence Kompakt type 770 machine was used. The machine had an ion-exchanger installed binding calcium ions from the inlet water. Temperature was set to 55° C. at program no. 4. This program performed the following:

a) Main wash starting with 7 minutes of heating of the cleaning solution from 25° C. to 55° C. and ending with 10 minutes of washing.

b) Cold rinsing water is taken in. This rinsing takes 5 minutes and the temperature during rinsing varies between 35 and 45° C. dependent on loading.

c) A second rinsing made with cold water which is taken in. During the second rinsing the water is heated from 20° C. to 55° C. for 8 minutes and then pumped out.

d) Drying at 55° C. for about 5 minutes.

Before and after washing, light reflection values are measured directly for protein film or for starch films stained with iodine ($KI/I_2$). The staining was made using a standard solution which was prepared the following way: 20.0 grams of potassium iodide (KI) Merck art. No. 5043 and 1.27 gram of iodine ($I_2$) Merck art. No. 4763 were weighed out in a 2 liter beaker and added up to 1.0 liter using ion exchanged water. The solution was stirred for approximately 10 minutes at room temperature.

The plates were pulled slowly through the iodine solution and afterwards placed in drying racks.

Measurements are made using a Minolta Chroma Meter (type CR-300). Six single values for each plate are used for an average R-value. Calculations of % removed film—RPF% for protein or RSF% for starch—are calculated by the formula:

$$RPF(\%)\ [\text{or } RSF(\%)] = [R_{after\ wash} - R_{before\ wash}]/[R_{clean\ plate} - R_{before\ wash}] * 100\%$$

Detergent composition used for one machine and the cleaning results obtained are shown in each of the tables belonging to the examples described below.

pH was varied by addition of 2–7 ml of 4 N HCl.

Method for Evaluating the Composition in Laundry

Test of washing performance was carried out in a commercial European washing machine (AEG model ÖKO-LAVAMAT JUBILEUM 40) with 2.0 kg of ballast laundry and artificially soiled fabrics. 10 pieces (5×5 cm) of a commercial "standard" swatch (standard cotton fabric) soiled with milk, blood and carbon black (EMPA 116) and 10 pieces of a swatch impregnated with an extract of spinach leaves and later on heat treated at 70° C. for 30 minutes were fixed onto the ballast cloth. The washing process was performed at 40° C. without pre-wash using a program called "Klarvask" according to the instructions by the vendor, with a final centrifugation at 1400 rpm. During the washing process a sample of the washing liquor was taken and the pH was measured using a pH-indicator strip type Acilit® pH 0–6. The washing process was followed by 2 rinsings with intermediate centrifugations at 400 rpm. In the total process a total volume of 50 liters of water were used.

Assessment of washed test swatches was done by measuring the intensity of reflected light, % R, (% remission) remitted from the swatches at 460 nm using a J&M Tidas MMS/16 photometer equipped with a CLX 75W Xenon lamp and fiber optics. Each swatch was measured individually at the top of a stack with 3 or 4 other swatches (in order to diminish the amount of light which may penetrate the textile structure without being absorbed or reflected).

The value $\Delta R_{Enz} = R_{washed} - R_{washed\ without\ enzyme}$ reflects the contribution of the enzyme for each type of swatch. The results are illustrated as mean values and as confidence intervals, e.g. as [% $R_{washed}$−W; % $R_{washed}$+W], where W is the 95% confidence value.

Used Chemicals/Enzymes a) NTA (nitrilotriacetic acid) available from Fluka Chemika no. 72560).

b) Trilon® A (NTA-$Na_3$—nitrilotriacetic acid trisodium salt) available from BASF - Germany.

c) Trilon® M (MGDA-$Na_3$—methylglycinediacetic acid trisodium salt) available from BASF - Germany d) Dehyphon® LS 54 (a non-ionic alcoholethoxylate) available from Henkel KGaA - Germany e) Lutensol® AO3 (a non-ionic alcoholethoxylate) available from BASF - Germany f) Lutensol® AO 7(a non-ionic alcoholethoxylate) available from BASF - Germany)

g) Sokalan® HP25 (a modified polycarboxylate) available from BASF - Germany; used as anti-redeposition agent.

h) Protease I (1.05 kHUT/g) obtained as described in WO 95/02044.

i) Protease II (5.22 kHUT/g) obtained as described in WO 95/02044.

j) Flavourzyme (65.2 kHUT/g) available from Novo Nordisk A/S, Denmark.

k) Fungamyl® available from Novo Nordisk A/S, Denmark.

EXAMPLES

Example 1

In this example the effect of the protease samples in ADW is demonstrated. The data are shown in Table 1.

TABLE 1

| Detergent | Trial 1.1 | Trial 1.2 | Trial 1.3 | Trial 1.4 |
|---|---|---|---|---|
| Citric acid | 3.0 g | 3.0 g | 3.0 g | 3.0 g |
| NTA—$Na_3$ (Trilon A) | 5.0 g | 5.0 g | 5.0 g | 5.0 g |
| Dehyphon LS 54 | 1.6 g | 1.6 g | 1.6 g | 1.6 g |
| $Na_2SO_4$ | 10 g | 10 g | 10 g | 10 g |
| Water: | | | | |
| Ion-exchanged in machine to 2–3° dH | Volume: 4 L | Volume: 4 L | Volume: 4 L | Volume: 4 L |
| 4 N HCl | 0 (pH was 4.5) | 0 (pH was 4.5) | 0 (pH was 4.5) | 0 (pH was 4.5) |
| Proteases: | | | | |
| Activity dosed and enzyme type | 2.1 kHUT from Protease I | 130.4 kHUT from Flavourzyme | 10.44 kHUT from Protease II | No enzyme |
| % RPF: | 60 | 16 | 20 | 12 |

Table 1 shows that Protease I gives the highest cleaning value (RPF%) even though the dosed HUT-activity is considerably less than for Flavourzyme and Protease II.

Example 2

In this example the effect of variation of pH on the performance of Protease I in ADW is demonstrated. pH was varied in the trials by dosing variable amounts of 4 N HCl. The data are shown in Table 2.

TABLE 2

| Detergent | Trial 2.1 | Trial 2.2 | Trial 2.3 |
|---|---|---|---|
| Citric acid | 3.5 g | 3.5 g | 3.5 g |
| NTA—$Na_3$ (Trilon A) | 3.0 g | 3.0 g | 3.0 g |
| Dehyphon LS 54 | 1.6 g | 1.6 g | 1.6 g |
| $Na_2SO_4$ | 10 g | 10 g | 10 g |
| Water: | | | |
| Ion-exchanged in machine to 2–3° dH | 4 L | 4 L | 4 L |
| Mass of 4 N HCl | 1.64 g | 3.48 g | 6.88 |
| pH | 4.5 | 4.0 | 3.2 |
| Protease: | | | |
| Activity dosed and enzyme type | 4.2 kHUT from Protease I | 4.2 kHUT from Protease I | No enzyme |
| % RPF: | 88 | 85 | 12 |

Table 2 shows that Protease I gives nearly the same cleaning value (RPF%) at pH 4 and pH 4.5. Even more acidic conditions (pH 3.2) without enzymes could not clean the plates to any visible degree.

Example 3

In this example the effect of additionally adding Fungamyl to a detergent and using porcelain plates coated with starch is tested. The data are shown in Table 3.

TABLE 3

| Detergent | Trial 3.1 | Trial 3.2 | Trial 3.3 | Trial 3.4 |
|---|---|---|---|---|
| Citric acid | 3.2 g | 3.2 g | 3.2 g | 3.2 g |
| NTA—$Na_3$ (Trilon A) | 3.0 g | 3.0 g | 3.0 g | 3.0 g |
| Dehyphon LS 54 | 1.6 g | 1.6 g | 1.6 g | 1.6 g |
| $Na_2SO_4$ | 10 g | 10 g | 10 g | 10 g |
| Water: | | | | |
| Ion-exchanged in machine to 2–3° dH | 4 L | 4 L | 4 L | 4 L |
| Mass of 4 N HCl | 3.5 g | 3.5 g | 3.5 g | 3.5 g |
| pH | 4.0 | 4.0 | 4.0 | 4.0 |
| Protease: | | | | |
| Activity dosed and enzyme type | 4.2 kHUT from Protease I | 4.2 kHUT from Protease I | No | No |
| Amylase: | | | | |
| Mass of Fungamyl 800 L | 0.12 g | 0 | 0.12 | 0 |
| % RPF | 76 | 75 | 3 | 9 |
| % RSF | 55 | 14 | 17 | 12 |

Table 3 shows the clear effect of Protease I on removal of protein whether the amylase was included or not. The amylase showed a minor effect when the Protease I was not included.

Example 4

In this example the hydrolytic effect of detergent solutions with acidic pepstatin-insensitive proteases were tested with and without egg white. Also the effect of using tap (slightly hard) water and ion exchanged water was tested. The data are shown in Table 4.

Freeze dried hemoglobin (Novo Nordisk - Denmark), was dissolved in tap water (18° dH (German degree water hardness), or in demineralized water to a 20 g/l solution.

1000 ml of a detergent solution was made by suspending/dissolving the following ingredients:

a) 12 g NTA b) 20 g Lutensol® A07 c) 62 g $Na_2SO_4$ in demineralized water to 1000 ml.

To 100 ml of the hemoglobin solution was added 5 g of the detergent solution in an Erlenmeyer flask with magnet stirring. pH was adjusted to 4.5 using NaOH. The flask was placed in a thermostated water bath at 40° C. 1000 $\mu$L of Protease I was added and samples were taken at t=1 minute and at t=30 minutes for measurement of osmolality (mOSM/kg $H_2O$) using an Osmometer, Type:Wide Range Osm.3 W 2 from Advanced Instruments. The result of the measurement may be presented as the difference of the two measurements as ΔmOSM/kg $H_2O$.

To test the inhibitory effect of, for example, egg white, 5 ml of gently homogenized egg white was added to the reaction mixture before enzyme addition.

TABLE 4

| Detergent | Trial 4.1 | Trial 4.2 | Trial 4.3 |
|---|---|---|---|
| NTA (Fluka) | 0.06 g | 0.06 g | 0.06 g |
| Lutensol ® AO 7 | 0.10 g | 0.10 g | 0.10 g |
| $Na_2SO_4$ | 0.31 g | 0.31 g | 0.31 g |
| Water: | | | |
| Ion-exchanged. | 4.53 g | 4.53 g | 4.53 g |
| Substrate: | | | |
| 1) Hemoglobin | 2.0 g | 2.0 g | 2.0 g |
| 2) Egg white | 0 | 0 | 5 ml |
| Substrate-Water: | | | |
| From the tap. | 0 g | 95.0 g | 0 g |
| Substrate-Water: | | | |
| Ion exchanged. | 95.0 g | 0 | 95.0 g |
| pH | 4.5 | 4.5 | 4.5 |
| Protease: | | | |
| Activity dosed and enzyme type | 3.0 kHUT from Protease I | 3.0 kHUT from Protease I | 3.0 kHUT from Protease I |
| mOSM/kg $H_2O$ | | | |
| at t = 1 minute | 56 | 67 | 63 |
| at t = 30 minutes | 66 | 75 | 78 |
| ΔmOSM/kg $H_2O$ | 10 | 8 | 15 |

Table 4 shows that Protease I effectively hydrolyzes the hemoglobin protein whatever the water used is from the tap or it is ion exchanged. Furthermore, it is shown clearly that Protease I is not to any degree inactivated by egg white. In fact, because a higher value of ΔmOSM/kg $H_2O$ was found when the egg white was present Protease I also hydrolyzes this protein. The 5 ml egg white add ca. 0.6 g of protein which is further hydrolyzed.

Example 5

In this example the hydrolytic effects of detergent solutions with different acidic pepstatin-insensitive proteases were tested by the method in example 4 using tap (slightly hard) water and ion exchanged water. The data are shown in Table 5.

TABLE 5

| Detergent | Trial 5.1 | Trial 5.2 | Trial 5.3 | Trial 5.4 |
|---|---|---|---|---|
| NTA-$Na_3$ (Trilon ® A) | 0.04 g | 0.04 g | 0.04 g | 0.04 g |
| NTA(Fluka) | 0.02 g | 0.02 g | 0.02 g | 0.02 g |
| Lutensol ® AO 3 | 0.03 g | 0.03 g | 0.03 g | 0.03 g |
| Lutensol ® AO 7 | 0.07 g | 0.07 g | 0.07 g | 0.07 g |
| Sokalan ® HP 25 | 0.07 g | 0.07 g | 0.07 g | 0.07 g |
| Water: | | | | |
| Ion-exchanged | 4.77 g | 4.77 g | 4.77 g | 4.77 g |
| Substrate: | | | | |
| 1) Hemoglobin | 2.0 g | 2.0 g | 2.0 g | 2.0 g |
| Substrate-Water: | | | | |
| From the tap | 0 | 0 | 95.0 g | 95.0 g |
| Substrate-Water: | | | | |
| Ion exchanged | 95.0 g | 95.0 g | 0 g | 0 g |
| pH | 4.5 | 4.5 | 4.5 | 4.5 |

TABLE 5-continued

| Detergent | Trial 5.1 | Trial 5.2 | Trial 5.3 | Trial 5.4 |
|---|---|---|---|---|
| Protease: | | | | |
| Activity dosed and enzyme type | 3.0 kHUT from Protease I | 65.2 kHUT from Flavour-zyme ® | 3.0 kHUT from Protease I | 65.2 kHUT from Flavour-zyme ® |
| mOSM/kg $H_2O$ | | | | |
| at t = 1 minute | 56 | 40 | 58 | 60 |
| at t = 30 minutes | 80 | 56 | 74 | 79 |
| ΔmOSM/kg $H_2O$ | 24 | 16 | 16 | 19 |

Table 5 shows that Protease I contributes with a higher hydrolytic effect in ion exchanged water even though the dosed HUT-activity is considerably less than for Flavourzyme. In tap (slightly harder) water the hydrolytic effects are comparable even though the dosed HUT-activity is considerably less than for Flavourzyme.

Example 6

In this example the laundry washing performance of Protease I was tested in a suitable slightly acidic laundry detergent composition.

TABLE 6

| Detergent | Trial 6.1 | Trial 6.2 |
|---|---|---|
| MGDA—$Na_3$ (Trilon ® M) | 13.8 g | 13.8 g |
| Lutensol ® AO 3 | 3.3 g | 3.3 g |
| Lutensol ® AO 7 | 6.4 g | 6.4 g |
| Sokalan ® HP 25 | 6.3 g | 6.3 g |
| Citric acid | 11.6 g | 11.6 g |
| $Na_2SO_4$ | 28.6 g | 28.6 g |
| Cloth with test pieces | 2 kg | 2 kg |
| Water per wash | 15 liter | 15 liter |
| pH in the wash water | ca. 4 | 3.5–4 |
| Protease: | | |
| Activity dosed and enzyme type | none | 300 kHUT from Protease I |
| Spinach: | | |
| Number of measurements: | 12 | 18 |
| Average % $R_{(i)}$ | 18.7 | 20.8 |
| W (95%) | 0.5 | 0.6 |
| [% $R_{(i)}$ − W; % $R_{(i)}$ + W] | [18.2;19.2] | [20.2;21.4] |
| $\Delta R_{Enz}$ | — | 2.1 |
| EMPA 116: | | |
| Number of measurements: | 12 | 24 |
| Average % $R_{(i)}$ | 16.1 | 20.2 |
| W (95%) | 0.9 | 0.7 |
| [% $R_{(i)}$ − W; % $R_{(i)}$ + W] | [15.2;17.0] | [19.6;20.9] |
| $\Delta R_{Enz}$ | — | 4.1 |

Table 6 shows that Protease I under these mild conditions significantly contributes to a cleaning of the two different swatches. The $\Delta R_{enz}$-values obtained are visible.

Example 7

In this example the sensitivity of Protease I and Protease II towards four different possible inhibitors are available from Sigma except for PEFABLOC which is available from Pentapharm, Basel, Switzerland was tested. EDTA is a metalloenzyme inhibitor, while PEFABLOC and PMSF are serine protease inhibitors. Proteolytic activity was measured in HPU/l at pH 5.5 protease solutions before and after treatment with the inhibitors.

Inhibition tests gave the following results:

| | % Residual activity | | | |
|---|---|---|---|---|
| | EDTA 100 mM | Pepstatin 1 mM | PEFABLOC 0.1% | PMSF 0.1% |
| Protease I | 104 | 91 | 83 | 92 |
| Protease II | 97 | 9 | 90 | 108 |

The test showed that Protease I retained activity in the presence of any of the inhibitors, while Protease II retained activity in the presence of EDTA, PEFABLOC and PMSF, but was inhibited by pepstatin.

REFERENCES

Muroa S. and Oda K. Pepstatin-insensitive acid proteinases, Asparctic proteinases and their inhibitors, Kostka V. (editor) pp 379–399, (1985) Walter de Gruyter, Berlin.

Kock H., Beck R., Röper H., Starch-Derived Products for Detergents, Starch/Stärke, 45, pp 2–7, 1993.

Stache H. Kosswig K., (editors) Tensid-Taschenbuch, 3 edition, Carl Hanser Verlag, München, 1990.

Oda K., and Murao S.; *Pepstatin-insensitive carboxyl proteases;* Structure and Function of the Aspartic Proteases; Dunn B. M. (Ed), Plenum Press, New York, 1991.

What is claimed is:

1. A method for cleaning or washing a hard surface, comprising contacting the hard surface with a composition which comprises (a) an *Aspergillus aculeatus* protease I having a pH optimum in the range of 3 to 6 and (b) at least one nonionic surfactant, dissolved in an aqueous solution in an amount sufficient for providing a cleaning effect, wherein the hard surface is industrial process equipment, household process equipment, health care equipment or animal care equipment.

2. The method of claim 1, wherein the nonionic surfactant is selected from the group consisting of glycolipids, alcohol ethoxylates, alkylphenolethoxylates, glucamides and alkylpolyglucosides.

3. The method of claim 1, wherein the composition further comprises a sequestering agent.

4. The method of claim 3, wherein the sequestering agent is capable of binding calcium ions at acidic pH.

5. The method of claim 3, wherein the sequestering agent is selected from the group consisting of methylglycinediacetic acid, nitrilotriacetic acid, citric acid, oligo and polymeric (poly)carboxylic acid derived from polymer sugars, dextrin and protein hydrolysates.

6. The method of claim 1, wherein the composition further comprises a component that enhances the detergency of the composition, wherein the component is selected from the group consisting of amylase, beta-glucanase, cellulase, laccase, lipase, pectinase, peroxidase, softening agent, xylanase, enhancing agent for the peroxidase/laccase, buffer and mixtures thereof.

7. The method of claim 1, wherein the protease is present in the aqueous solution in a range from 500–3000 HUT/L.

8. The method of claim 7, wherein the protease is present in the aqueous solution in a range from 500–1500 HUT/L.

9. The method of claim 8, wherein the protease is present in the aqueous solution in a range from 750–1250 HUT/L.

10. The method of claim 9, wherein the protease is present in the aqueous solution at 1000 HUT/L.

11. The method of claim 1, wherein the hard surface is industrial process equipment.

12. The method of claim 11, wherein the industrial process equipment is selected from the group consisting of heat exchangers, tanks, pipes, centrifuges, evaporators, filters, extruders, meat choppers, cooking jars, beer and wine fermentors, beer and wine filters, spent filter aids, coolers, storage tanks, sieves, hydrocyclones, ultrafiltration units, nanofiltration units, hyperfiltration units, microfiltration units, ion exchanger columns, gel filtration columns and milking machines.

13. The method of claim 1, wherein the hard surface is household process equipment.

14. The method of claim 13, wherein the household process equipment is selected from the group consisting of eating utensils, plates, cups, beakers, glasses, pots, pans, electric appliances, toilet bowls, lavatories and tiles.

15. The method of claim 13, wherein the method is a cleaning in place (CIP) method.

16. The method of claim 13, wherein the household process equipment is cleaned in an automatic dish washing machine.

17. The method of claim 1, wherein the hard surface is health care or animal care equipment.

18. The method of claim 1, wherein the health care or animal care equipment is selected from the group consisting of diagnostic, analytical, processing and surgical equipment.

19. The method of claim 1, wherein the pH of the composition is between 4–5.

20. The method of claim 1, wherein the temperature of the composition is between 10–65° C.

21. The method of claim 20, wherein the temperature is between 30–50° C.

22. The method of claim 21, wherein the temperature is 40° C.

23. The method of claim 1, wherein the surface is cleaned for a time period between 2 minutes and 20 hours.

* * * * *